US007216388B2

(12) United States Patent
Bieganek et al.

(10) Patent No.: US 7,216,388 B2
(45) Date of Patent: May 15, 2007

(54) CONTOURED SEAT CUSHION AND METHOD FOR OFFLOADING PRESSURE FROM SKELETAL BONE PROMINENCES AND ENCOURAGING PROPER POSTURAL ALIGNMENT

(75) Inventors: Joseph S. Bieganek, Littleton, CO (US); Thomas R. Hetzel, Littleton, CO (US)

(73) Assignee: Aspen Seating, LLC, Sheridan, CO (US)

( * ) Notice: Subject to any disclaimer, the term of this patent is extended or adjusted under 35 U.S.C. 154(b) by 0 days.

(21) Appl. No.: 10/628,860

(22) Filed: Jul. 28, 2003

(65) Prior Publication Data

US 2005/0022305 A1 Feb. 3, 2005

(51) Int. Cl.
*A47C 7/18* (2006.01)
*A61G 5/10* (2006.01)

(52) U.S. Cl. ..... 5/653; 297/452.26; 297/452.28; 6/601

(58) Field of Classification Search ..... 5/630, 5/652, 653, 655.9, 654, 654.1; 297/452.23, 297/452.26, 452.28, 452.27; D6/502, 601
See application file for complete search history.

(56) References Cited

U.S. PATENT DOCUMENTS

| | | | | |
|---|---|---|---|---|
| 1,309,725 | A * | 7/1919 | Gerstenmaier | 297/452.25 |
| D59,900 | S | 12/1921 | Marsh | |
| 1,742,183 | A | 1/1930 | Claus | |
| 1,961,641 | A | 6/1934 | Ollis | |
| 2,156,629 | A | 5/1939 | Hutchison | |
| 2,384,713 | A | 9/1945 | Varma | |
| 2,472,754 | A | 6/1949 | Mead | |
| D169,366 | S | 4/1953 | Feldman | |
| 2,659,418 | A | 11/1953 | Berman | |
| 2,847,061 | A * | 8/1958 | Morton | 297/452.28 |
| 2,933,738 | A | 4/1960 | Whelan | |
| 3,158,878 | A | 12/1964 | Pernell | |
| 3,177,036 | A | 4/1965 | Halter | |
| 3,222,694 | A | 12/1965 | Schick | |
| 3,503,649 | A * | 3/1970 | Johnson | 297/452.26 |
| 3,511,537 | A | 5/1970 | Ackermann | |
| 3,749,442 | A | 7/1973 | Berg et al. | |
| D238,235 | S | 12/1975 | Elgebrandt | |
| 3,987,507 | A | 10/1976 | Hall | |
| 4,132,228 | A | 1/1979 | Green | |

(Continued)

FOREIGN PATENT DOCUMENTS

| | | |
|---|---|---|
| FR | N768163 | 8/1934 |

(Continued)

*Primary Examiner*—Michael Safavi
(74) *Attorney, Agent, or Firm*—John R. Ley

(57) ABSTRACT

A support contour of a cushion, such as a wheelchair cushion, defines relief areas at locations adjacent to skin covering the ischial tuberosities, the greater trochanters and the coccyx and sacrum of a person sitting on the support contour. Support areas of the support contour transfer force into the pelvic area adjacent to skin covering tissue masses on opposite lateral sides of the posterior buttocks and beneath the proximal thighs of the person. Greater clearance is also provided in the perineal area. Risks of pressure ulcers from pressure and shear forces on bony prominences is reduced while providing support at the broader areas without bony prominences in such a manner to encourage postural alignment. The risks of skin breakdown perineal are diminished.

23 Claims, 8 Drawing Sheets

U.S. PATENT DOCUMENTS 4,327,046 A 4/1982 Davis et al.
4,347,213 A 8/1982 Rogers, Jr.
D278,779 S 5/1985 Sink
4,522,447 A 6/1985 Snyder et al.
4,567,887 A 2/1986 Couch, Jr.
4,588,229 A 5/1986 Jay
4,615,856 A 10/1986 Silverman
4,643,481 A 2/1987 Saloff et al.
D289,481 S 4/1987 Reddick
4,682,818 A 7/1987 Morell
4,726,624 A 2/1988 Jay
4,753,480 A 6/1988 Morell
4,756,090 A 7/1988 Pedrow
4,763,951 A * 8/1988 Silverman ..... 297/452.28
4,824,174 A 4/1989 Dunn, Sr.
4,828,325 A * 5/1989 Brooks ..... 297/452.28
4,842,330 A 6/1989 Jay
4,889,387 A 12/1989 Gregory
4,890,235 A 12/1989 Reger et al.
4,912,788 A 4/1990 Lonardo
4,951,334 A 8/1990 Maier
4,972,351 A 11/1990 Reger et al.
4,998,354 A 3/1991 Silverman et al.
5,018,790 A 5/1991 Jay
D318,923 S 8/1991 Marsh
5,079,790 A 1/1992 Pouch
5,092,655 A 3/1992 Deegener et al.
5,163,737 A 11/1992 Navach et al.
5,180,619 A 1/1993 Landi et al.
5,189,747 A 3/1993 Mundy et al.
5,193,285 A 3/1993 Heinrich et al.
D335,235 S 5/1993 Hildreth
5,255,404 A 10/1993 Dinsmoor, III et al.
D342,411 S 12/1993 Graebe
5,282,286 A 2/1994 MacLeish
5,288,135 A 2/1994 Forcier et al.
5,294,181 A 3/1994 Rose et al.
5,317,773 A 6/1994 Graebe
5,333,921 A 8/1994 Dinsmoor, III
5,343,876 A 9/1994 Rogers
5,352,023 A 10/1994 Jay et al.
5,369,829 A 12/1994 Jay
5,378,045 A 1/1995 Siekman et al.
5,390,384 A 2/1995 Dinsmoor, III et al.
5,395,162 A 3/1995 Jay et al.
5,397,517 A 3/1995 Jay et al.
5,414,884 A 5/1995 Mackenzie
5,442,823 A 8/1995 Siekman et al.
5,444,881 A 8/1995 Landi et al.
5,452,940 A 9/1995 Maier
5,457,833 A 10/1995 Jay
5,461,741 A 10/1995 Graebe
5,470,590 A 11/1995 Brubaker et al.
5,490,299 A 2/1996 Dinsmoor, III et al.
5,496,610 A 3/1996 Landi et al.
5,513,899 A 5/1996 Michaels et al.
5,522,106 A 6/1996 Harrison et al.
5,524,971 A 6/1996 Jay et al.
5,551,107 A 9/1996 Graebe
5,551,756 A 9/1996 Gurasich et al.
5,592,707 A 1/1997 Dinsmoor, III et al.
5,613,256 A 3/1997 Hanson
5,613,257 A 3/1997 Graebe
5,617,595 A * 4/1997 Landi et al. ..... 5/653
5,657,499 A * 8/1997 Vaughn et al. ..... 5/654
5,671,977 A 9/1997 Jay et al.
5,681,092 A 10/1997 Hanson et al.
5,687,436 A 11/1997 Denton
5,836,025 A 11/1998 Poncy, Sr.
5,840,400 A 11/1998 Landi et al.
5,845,352 A 12/1998 Matsler et al.
5,920,915 A 7/1999 Bainbridge et al.
6,018,832 A 2/2000 Graebe
D421,359 S * 3/2000 Liao ..... D6/502
6,032,300 A 3/2000 Bainbridge et al.
6,055,676 A 5/2000 Bainbridge et al.
6,082,824 A 7/2000 Chow
6,161,238 A 12/2000 Graebe
6,182,314 B1 2/2001 Frydman
6,241,320 B1 6/2001 Chew et al.
6,293,026 B1 9/2001 Lee et al.
6,293,625 B1 9/2001 Dixon
6,301,722 B1 10/2001 Nickerson et al.
6,345,401 B1 2/2002 Frydman
6,357,054 B1 3/2002 Bainbridge et al.
6,453,477 B1 9/2002 Bainbridge et al.
6,493,958 B1 12/2002 Tadin
6,502,263 B1 1/2003 Rowley et al.
6,611,980 B2 9/2003 Wempe
6,625,897 B2 9/2003 Tadin
2001/0013146 A1 8/2001 Wempe
2002/0014794 A1 2/2002 Chow
2003/0121103 A1 7/2003 Wempe
2005/0025956 A1 * 2/2005 Bainbridge ..... 428/317.7

FOREIGN PATENT DOCUMENTS

GB 2016918 10/1979

* cited by examiner

CONTOURED SEAT CUSHION AND METHOD FOR OFFLOADING PRESSURE FROM SKELETAL BONE PROMINENCES AND ENCOURAGING PROPER POSTURAL ALIGNMENT

CROSS-REFERENCE TO RELATED APPLICATIONS

This invention is related to other inventions made by at least one of the inventors herein for Individually-Contoured Seat Cushion and Shape Capturing and Fabricating Method for Seat Cushion described in U.S. patent application Ser. No. 10/628,858, and for Modular Seat Cushion with Interlocking Human Support and Base Portions and Method of Creating a Seat Cushion described in U.S. patent application Ser. No. 10/628,859, and for Apparatus and Method for Evaluating Clearance from a Contoured Seat Cushion described in U.S. patent application Ser. No. 10/628,890, all of which are filed concurrently herewith and all of which are assigned to the assignee of the present invention. The subject matter of these concurrently-filed applications is incorporated herein by reference.

FIELD OF THE INVENTION

This invention relates to seat cushions, and more particularly, to a new and improved seat cushion having a support contour which avoids or reduces the incidence of pressure ulcers while simultaneously orienting the user toward maintaining proper posture. The support contour offloads or isolates pressure and shear forces from skin tissue surrounding the bony prominences of the pelvic skeletal bone structure, such as the ischial tuberosities, greater trochanters, coccyx and sacrum, thereby removing pressure and shear forces from those areas which are susceptible to injury from prolonged sitting. Proper postural alignment is achieved by transferring the pressure from the offloaded areas to greater masses of tissue not associated with bony prominences, such as the proximal thighs and the posterior lateral buttocks. The additional support from these areas encourages improved postural alignment and control.

BACKGROUND OF THE INVENTION

A wheelchair seat cushion must perform a number of important functions. The seat cushion should be comfortable and capable of providing proper support for optimal posture and posture control for a considerable length of time. The seat cushion should also assist, or at least not materially hinder, the user in maneuvering the wheelchair, permit a useful range of motion from the pelvis and upper torso of the person, and create stability and security for the person within the wheelchair. Perhaps most importantly, the seat cushion should help prevent and reduce the incidence of pressure ulcers created by prolonged sitting on the cushion without adequate pressure relief. Pressure ulcers can become a very serious health problem for individuals who must remain constantly in contact with the support cushion, and it is important to avoid such pressure ulcers.

Wheelchair users are of substantially different sizes, weights and shapes. Many wheelchair users have physical disabilities and associated posture and postural control impairments such as those typically caused by congenital disorders. Other wheelchair users, such as those who have been disabled by acquired or traumatic injuries, may have a more typical size and shape. In all of these cases, the support contour of the wheelchair seat cushion must safely support the anatomy of the user, whether the anatomy is abnormal or more typical. Wheelchair seat cushions must fit and perform properly to prevent further physical impairment and pressure ulcers. The cushion must also enhance the functional capabilities of the user by supporting independence in activities of daily living. There are a number of different theories or approaches for configuring the support contour of a wheelchair seat cushion to avoid pressure ulcers and to provide adequate postural alignment.

One approach to configuring the support contour of a wheelchair seat cushion is a single generic support contour which attempts to accommodate all types of pelvic bone-structure configurations, whether more abnormal or more typical. In general, this generic approach involves using a soft, flowable or adaptable material, such as air or gel, as the support material within the wheelchair cushion. This adaptable material adjusts and redistributes in response to the weight and shape of the user to create a support contour which conforms to the anatomy of the user. By conforming to the anatomy of the user, the pressure on the skin of the user is usually distributed relatively evenly over the area of contact. The extent of the uniform pressure distribution depends on the capability of the cushion to accept and conform to the user's anatomy without displacing the adaptable material and resulting in firm contact with a support structure.

The substantially equal pressure distribution is theorized to reduce the incidence of pressure ulcers, by decreasing peak pressures on the skin in the pelvic area associated with bony prominences, most notably the ischial tuberosities, coccyx, sacrum, and greater trochanters. However, as individuals age with their disabilities, the quality of their skin is further compromised in its ability to tolerate pressure and shear forces. The decreased tolerance for pressure and shear forces, no matter how well those forces are distributed, increases the incidence of pressure ulcers.

Generic seat cushions which use flowable support material are usually incapable of providing adequate postural alignment. In general terms, adequate postural alignment is assisted by using the support contour of the seat cushion to encourage proper posture by providing a foundation for dynamic posture control. To do so, the support contour must have the capability of applying some support pressure to the pelvic area because alignment of the pelvic area is fundamental for proper posture. The adaptable support material of generic seat cushions is intended to move and redistribute itself, and consequently, is generally unstable and incapable of applying the support pressure or force in certain areas of the pelvic anatomy to optimize postural control and alignment.

Many of the disadvantages associated with generic wheelchair cushions may be overcome by using a custom wheelchair seat cushion having a support contour constructed specifically to accommodate the individual anatomical aspects of a particular user. In such cases, it is necessary to capture the anatomical shape of the individual which will contact the custom seat cushion, and then use that anatomical shape to make the custom seat cushion.

The cost of fabricating a custom wheelchair seat cushion can be substantial, for example, approximately $3000 or more. Much of the expense of a custom wheelchair seat cushion results from the amount of time consumed, and the cost of the relatively sophisticated equipment which must be used to capture and transfer the anatomical shape of the user into the support contour of the seat cushion. Moreover, despite the use of sophisticated equipment, it is nevertheless difficult to capture the anatomical shape of the user and transfer it into a customized support contour. An appreciation of some of these difficulties in creating customized wheelchair seat cushions is discussed in the above-referenced U.S. patent application Ser. No. 10/628,858.

The most prevalent approach used to configure the support contour of a custom cushion, at least at the time of filing hereof, is to distribute the weight of the user substantially uniformly over the entire support contour. The uniform pressure distribution is theorized to reduce the incidence of pressure ulcers because the uniform pressure distribution is thought to avoid localized high-pressure points which could give rise to pressure ulcers. The substantial conformance of the support contour to the anatomical shape of the user is also believed to orient the user toward proper postural alignment.

Even if the support contour of the custom cushion is initially satisfactory to the user, changes in tissue and musculature may dictate changes in the optimal support contour of the custom seat cushion. Tissue will typically atrophy over time, particularly for first-time wheelchair users. Tissue atrophy and other tissue changes alter the pressure distribution over the support contour. Those changes may result in increased pressure on tissues surrounding the bony prominences, thereby ultimately increasing the risks of pressure ulcers. Moreover, as the muscle strength diminishes, the user relies more on the support contour of the seat to hold the proper posture. In doing so, parts of the pelvic anatomy press more directly on certain parts of the support contour as a foundation for postural alignment. The increased pressure from postural alignment increases the pressure and shear forces on the skin in those areas, again increasing the risk of pressure ulcers. In general, the concept of equally distributing the pressure over the entire support contour of the custom seat cushion is generally obtainable only for a limited amount of time and under limited circumstances. Additionally, any movement of the user, or even subtle changes in pelvic orientation on the support contour, can result in substantial increases in pressure and shear forces on the skin at the interface with the support contour.

One type of existing wheelchair cushion includes a cutout area adjacent to the tailbone or sacrum in the pelvic area. This cutout area is effective in eliminating pressure or shear forces which could cause pressure ulcers on the skin surrounding the sacrum. However, the single cutout area does not address the increased pressure and shear forces which occur at the areas of other bony prominences in the pelvic area. Moreover, the support contour of the cushion with the cutout area does not attempt to transfer support to other pelvic areas to compensate for the reduced support at the cutout area. This type of cushion is not generally intended to encourage or bias the pelvic area into alignment for proper posture. Instead, this type of cushion is intended to be used with a separate back support cushion in order to invoke postural alignment.

Many of the same considerations applicable to wheelchair seat cushions also apply with varying levels of criticality to other types of seat cushions used in other seating environments and applications. For example, seat cushions used in office environments are required to support the user in a comfortable manner which encourages proper posture and without creating risks of medical problems, for example inducing blood circulatory problems.

SUMMARY OF THE INVENTION

The present invention involves configuring a support contour for a seat cushion to isolate and offload pressure and shear forces from the skin surrounding the bony prominences of the pelvic area skeletal structure and to transfer greater pressure and provide firmer support to areas of the anatomy which have broader masses of soft and muscle tissue not surrounding bony prominences. Offloading or isolating the pressure and shear force from the skin surrounding the bony prominences of the pelvic skeletal structure reduces the risk of pressure ulcers. Transferring pressure and providing pronounced support to broader masses of soft and muscle tissue encourages better balance and alignment. The support pressure is applied to those broader and more distributed skeletal areas which are capable of withstanding increased pressure without substantially increasing the risk of pressure ulcers. The greater support pressure is applied to those areas which bias, orient or encourage alignment of the pelvic structure toward proper postural alignment. By offloading the pressure and shear forces from those areas which are prone to skin ulcers, and transferring support pressure to those areas which encourage proper postural alignment, the support contour of the seat cushion simultaneously achieves the two most important functions of a wheelchair cushion: avoidance of pressure ulcers and postural alignment and control.

The support contour of the present invention is also more accepting of tissue changes and atrophy without substantially diminishing its essential functions of avoiding pressure ulcers and encouraging proper postural alignment. Offloading the pressure from the bony prominences of the pelvic area is achieved primarily by increasing the space or clearance between the support contour and the bony prominences. The increased space or clearance inherently absorbs and compensates for a reasonable range of tissue and musculature changes in the pelvic area while maintaining adequate clearance. The areas of increased pressure and support are the areas where pressure should be applied for proper postural alignment in a manner somewhat independent of the amount of tissue in those locations. Therefore, the added support in those areas is likely to remain effective even as the tissue in those areas may atrophy.

The support contour of the present invention is also more adaptable to a wider range of variations in the size and shape of the normal human anatomy, primarily as a result of the additional clearance in the areas of the bony prominences and the additional support in the areas of broader tissue and muscular masses. The greater relief or clearance in the areas of the bony prominences and the greater support in the areas of broader tissue and muscular mass, makes the support contour generally applicable to classes of individuals having generally similar pelvic anatomies. Only a few different seat cushions, each having adjusted proportions, may prove adequate to support a substantial population of wheelchair and other users having typical pelvic anatomies. Consequently, the production of seat cushions embodying the present invention in only a few different sizes may obtain the type of significant benefits for a broad population of users which have previously been reserved to more costly custom seat cushions. The support contour also accommodates a reasonable range of normal and desirable pelvic movement, as well as a degree of positioning tolerance. Such tolerance reflects an improvement over conventional custom cushions that function optimally in only one static posture position without tolerance for any movement or positioning error.

These and other features and aspects of the invention are realized in a support contour for contacting and supporting a person in a sitting position. The support contour defines relief areas at locations adjacent to skin covering the ischial tuberosities, the greater trochanters and the coccyx and sacrum of the person sitting on the support contour. The support contour also defines support areas adjacent to skin covering tissue masses on opposite lateral sides of the posterior buttocks and beneath the proximal thighs of the person. The relief areas and support areas are spaced relatively more away from and relatively more toward an anatomical shape of the person, respectively, to establish relatively less pressure on the skin in the relief areas and relatively more pressure on the skin in the support areas.

The relief areas of the support contour obtain preferable improvements and features. The relief areas substantially offload pressure on the skin covering the ischial tuberosities, the greater trochanters and the coccyx and sacrum. The relief area adjacent to the ischial tuberosities has sufficient longitudinal, transverse and vertical dimensions to establish the relatively less pressure on the skin covering the ischial tuberosities during forward and backward pivoting movement of the upper torso of the person sitting on the support contour. The relief area adjacent to the greater trochanters has sufficient longitudinal, transverse and vertical dimensions to establish the relatively less pressure on the skin covering the greater trochanters during movement within an anticipated range of normal sitting positions of the person on the support contour. The relief area for the coccyx and sacrum extend into a rear wall of the support contour and has dimensions extending longitudinally and transversely relative to the coccyx and sacrum to establish the relatively less pressure on the skin covering the coccyx and sacrum during an anticipated range of normal movement.

The support areas of the support contour also obtain preferable improvements and features. The support areas transfer sufficient force to the tissue masses at the lateral posterior buttocks and proximal thighs to substantially only support the person on the support contour at the support areas. The support areas on opposite lateral sides of the posterior buttocks induce an upward component of support force on the pelvic area of the person. The support areas beneath the proximal thighs function in a fulcrum-like manner to transfer weight from the distal legs to the proximal thighs in a lever-like manner through hip joints to elevate the pelvic area of the person in a complementary manner with the support areas at the posterior lateral buttocks, thereby contributing to the offloading in the relief areas.

Another aspect of the invention involves a method of configuring a support contour to contact and support a person sitting on the support contour. The method comprises defining relief areas in the support contour at locations adjacent to skin covering the ischial tuberosities, the greater trochanters and the coccyx and sacrum of the person sitting on the support contour, and defining support areas in the support contour at locations adjacent to skin covering tissue masses on opposite lateral sides of the posterior buttocks and beneath the proximal thighs of the person. The relief areas and the support areas are positioned to establish a relatively greater clearance with respect to the schial tuberosities, the greater trochanters and the coccyx and sacrum of the person sitting on the support contour compared to a relatively lesser clearance with respect to the tissue masses on the opposite lateral sides of the posterior buttocks and beneath the proximal thighs of the person sitting on the support contour. The methodology also involves configuring the seat contour to obtain above noted and other preferable improvements. Additionally, this method, like the support contour noted above, may also include additional clearance in the perineal or genital area for increased air circulation to counteract heat and humidity influences that may cause skin breakdown in that area.

A further aspect of the present invention involves a method of supporting a person sitting on a support contour. The substantial majority of force associated with supporting the person on the support contour is transferred to skin covering tissue masses on opposite lateral sides of the posterior buttocks and beneath the proximal thighs of the person while the person is sitting on the support contour. Pressure and shear force from skin surrounding the ischial tuberosities, the greater trochanters and the coccyx and sacrum of the person seated on the support contour is substantially diminished by transferring the sitting-associated force. The person may also be supported in a manner to obtain the above noted and other preferable improvements.

A more complete appreciation of the scope of the invention and the manner in which it achieves the above-noted and other improvements can be obtained by reference to the following detailed description of presently preferred embodiments taken in connection with the accompanying drawings, which are briefly summarized below, and by reference to the appended claims.

DETAILED DESCRIPTION

Figure 1:
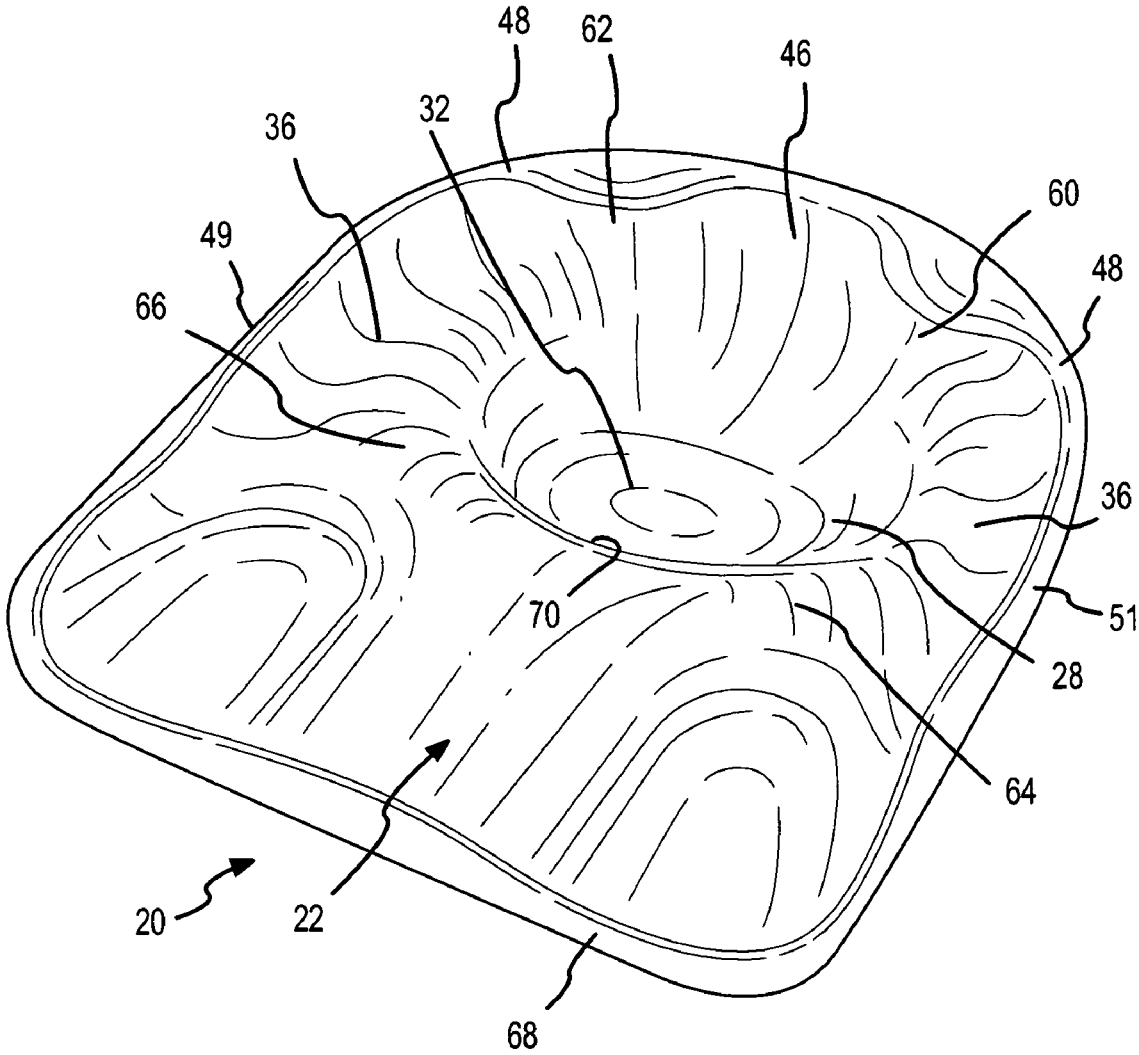
FIG. 1 is a perspective view of a support contour of a wheelchair or other seat cushion which incorporates the present invention.

A wheelchair seat cushion 20 having a support contour 22 which incorporates the present invention is shown in FIG. 1. In general, the wheelchair support cushion 20 is constructed of resilient plastic foam material, which is capable of providing the necessary resilience and support to the wheelchair user. The configuration of the support contour 22 is preferably constructed or otherwise molded as a part of the seat cushion 20. Preferably, the resilient plastic foam material from which the seat cushion 20 is formed is a matrix of polyurethane or polyethylene plastic beads which have been adhered together during a molding process in which the support contour 22 is formed simultaneously with the seat cushion 22, as described more completely in the above-referenced U.S. patent application Ser. No. 10/628,858.

The support contour 22 faces upward to contact and support the tissues of the user which surround the skeletal structure of the pelvic area 24 and the thigh bones 26 of the user, as shown in FIGS. 2–7. The support contour 22 includes a relatively deep center cavity 28 which is positioned in the support contour 22 to be located directly below ischial tuberosities 30 of the pelvic area skeletal structure 24, when the user is seated on the cushion 20. The ischial tuberosities 30 are sometimes referred to in common language as the "seat bones." An individual of relatively normal posture and anatomy sits on his or her ischial tuberosities. An individual with normal posture and anatomy is usually supported substantially only from his or her ischial tuberosities 30 when that person is seated on a horizontal substantially rigid surface.

Figure 8:
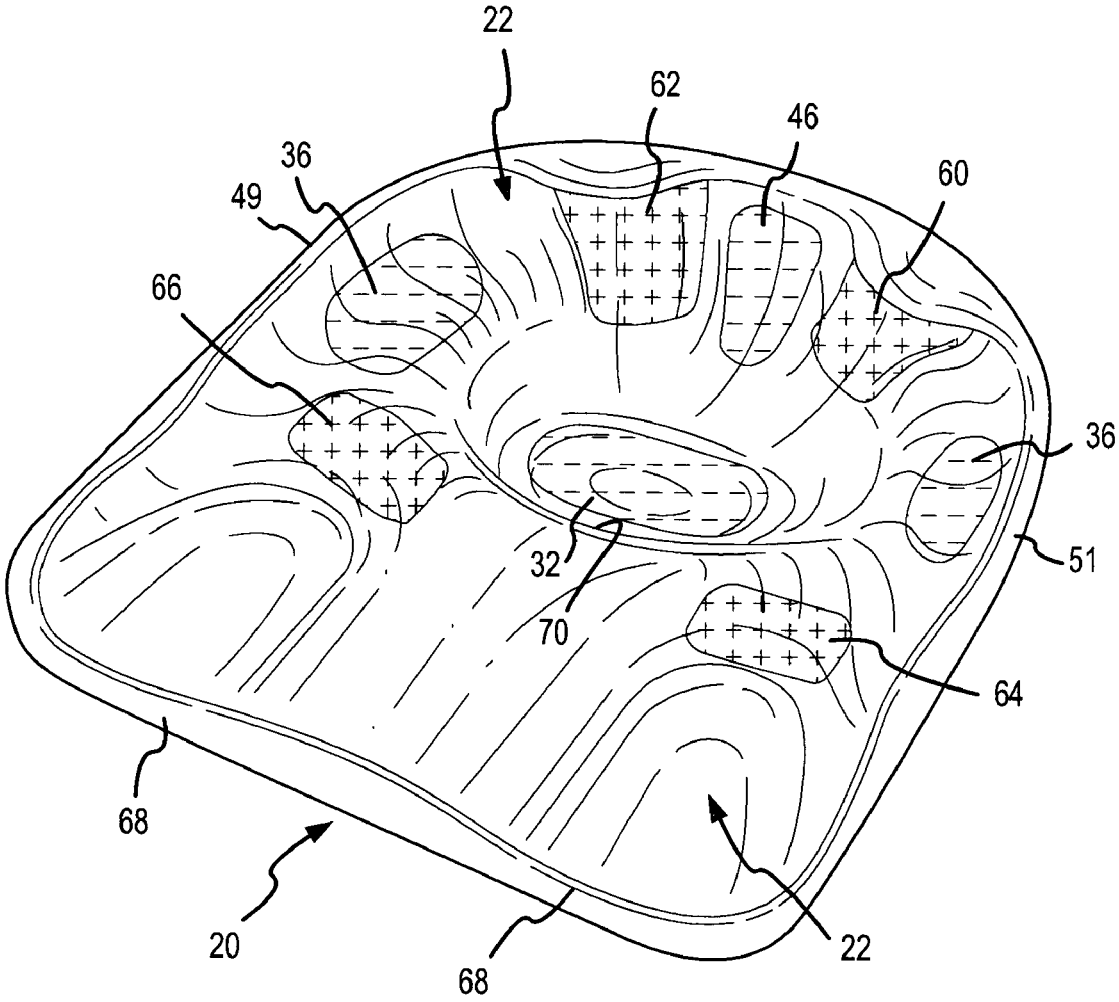
FIG. 8 is a perspective view similar to FIG. 1 with shading and crosshatching to illustrate areas of the support contour where pressure is offloaded and areas where additional support is provided, in accordance with the present invention.

In the support contour 22, the vertical depth and horizontal dimensions of the cavity 28 are sufficient to offload pressure and shear force from the skin surrounding the ischial tuberosities 30. In order to offload pressure and shear force from the skin surrounding the ischial tuberosities, the cavity 28 extends downward to a lowermost portion represented by a generally horizontal lowermost surface area 32. The depth of the cavity 28 is sufficient to establish a vertical clearance 34 between the lower ends of the ischial tuberosities 30 and the lowermost surface area 32, as shown in FIGS. 3, 4 and 8.

Figure 3:
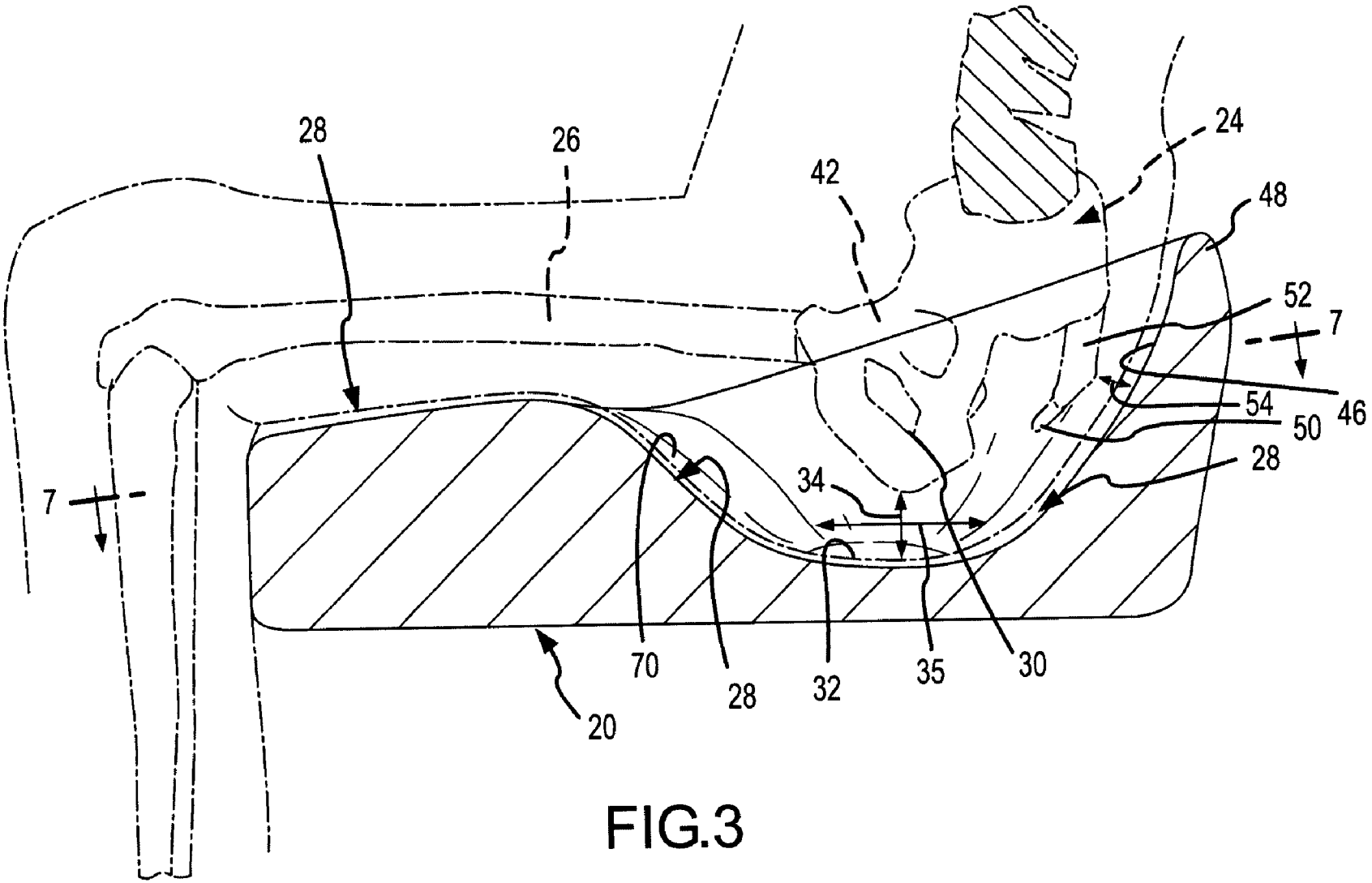
FIG. 3 is a midline longitudinal and vertical cross-sectional view taken substantially in the plane of line 3—3 of FIG. 2.

As shown in FIG. 3, the longitudinal extent of the lowermost surface area 32 extends the clearance 34 over a longitudinal range 35 sufficient to accommodate the normal forward and backward movement of the lower ends of the ischial tuberosities 30. Normal forward and backward pivoting movement of the upper torso of the user will cause the lower ends of the ischial tuberosities 30 to move forward and backward. The depth and shape configuration of the support contour 22 at the lowermost surface area 32 assures that sufficient longitudinal clearance 35 to accommodate this typical forward and backward movement of the lower ends of the ischial tuberosities 30.

Figure 4:
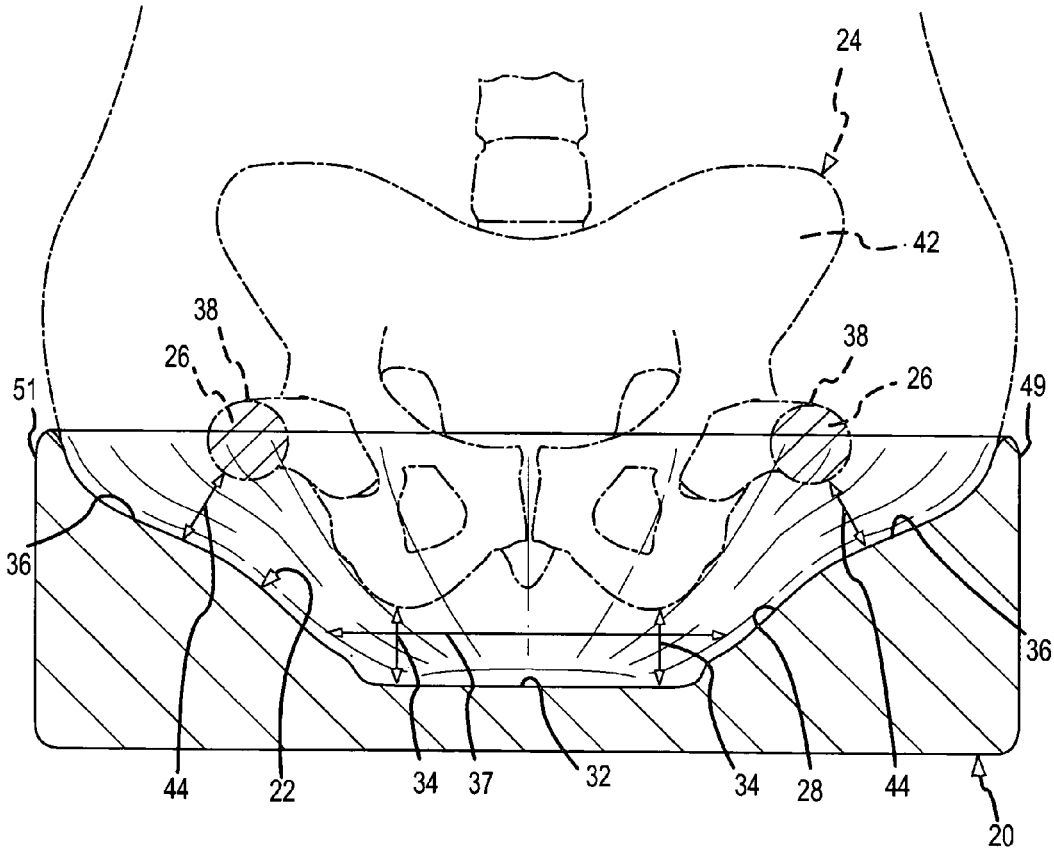
FIG. 4 is a transverse and vertical cross-sectional view taken substantially in the plane of line 4—4 of FIG. 2.

As shown in FIG. 4, the lowermost surface area 32 also extends a transverse distance within the cavity 28 to extend a transverse clearance 37 beyond the lower ends of the ischial tuberosities 30. The extent of the lowermost surface area 32 assures a sufficient amount of transverse clearance 37 to accommodate a normal range of side to side movement of the upper torso during typical activity such as extending an arm to one side of the upper torso when reaching for an object. The pelvic area skeletal structure 24 may pivot slightly laterally in this case, causing one of the ischial tuberosities 30 to elevate and the other to descend slightly. The depth of the lowermost surface area 32 also provides sufficient vertical clearance 34 to accommodate this type of tilting.

The extent of the vertical clearance 34, the longitudinal clearance 35 and the transverse clearance 37, as established by the depth of the cavity 28 and the horizontal extent of the lowermost surface area 32, offloads pressure and shear forces from the skin and other tissue surrounding the ischial tuberosities 30. The pressure and shear forces are offloaded under both static sitting conditions, and under conditions of dynamic movement while in the seated position. By offloading the pressure and shear force from the skin surrounding the ischial tuberosities 30 due to the clearances 34, 35 and 37, the risk of pressure ulcers on the skin surrounding the ischial tuberosities 30 is reduced substantially.

Figure 2:
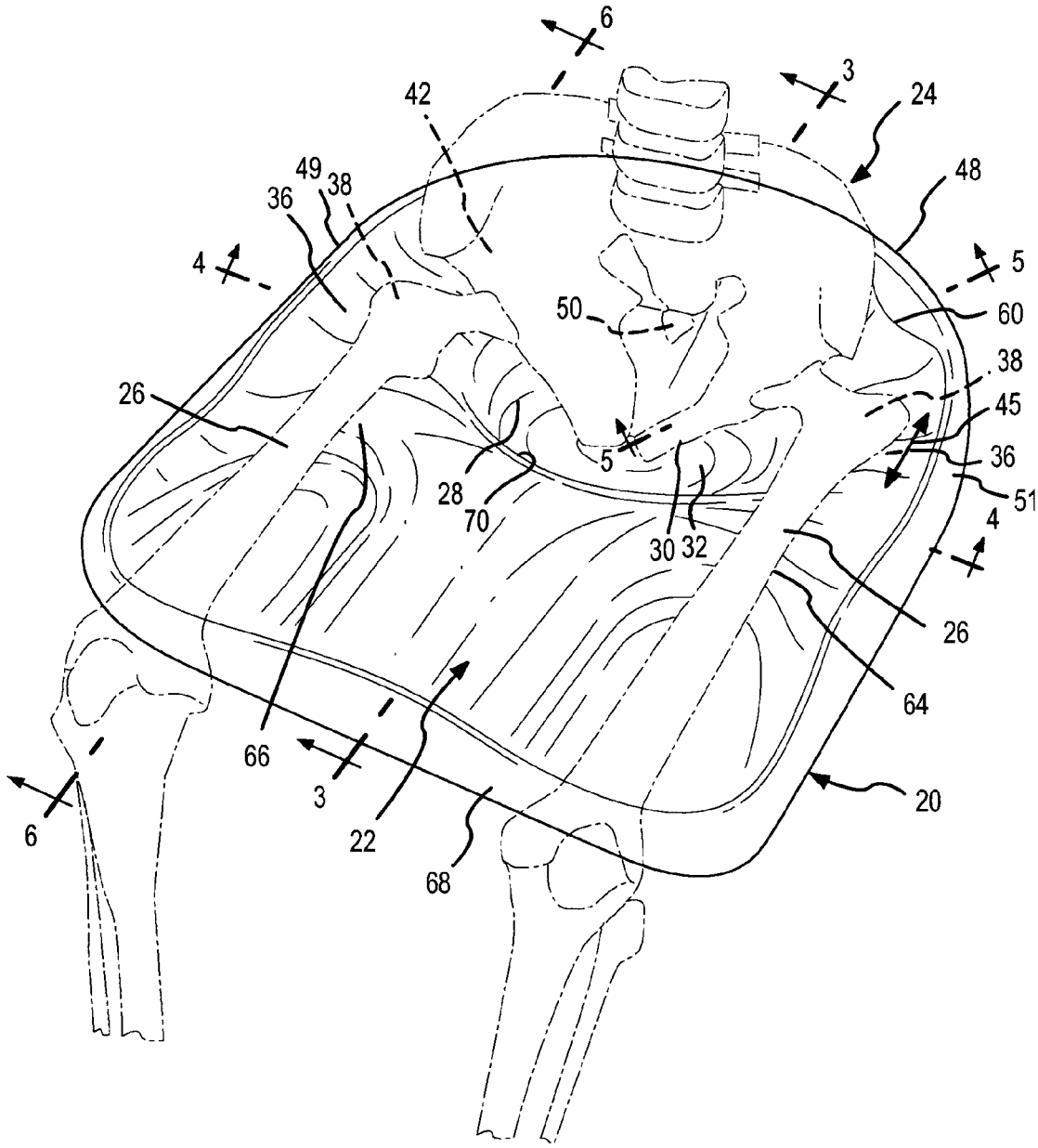
FIG. 2 is a perspective view similar to FIG. 1, showing a typical human pelvic and thigh skeletal structure superimposed over the support contour shown in FIG. 1.
Figure 6:
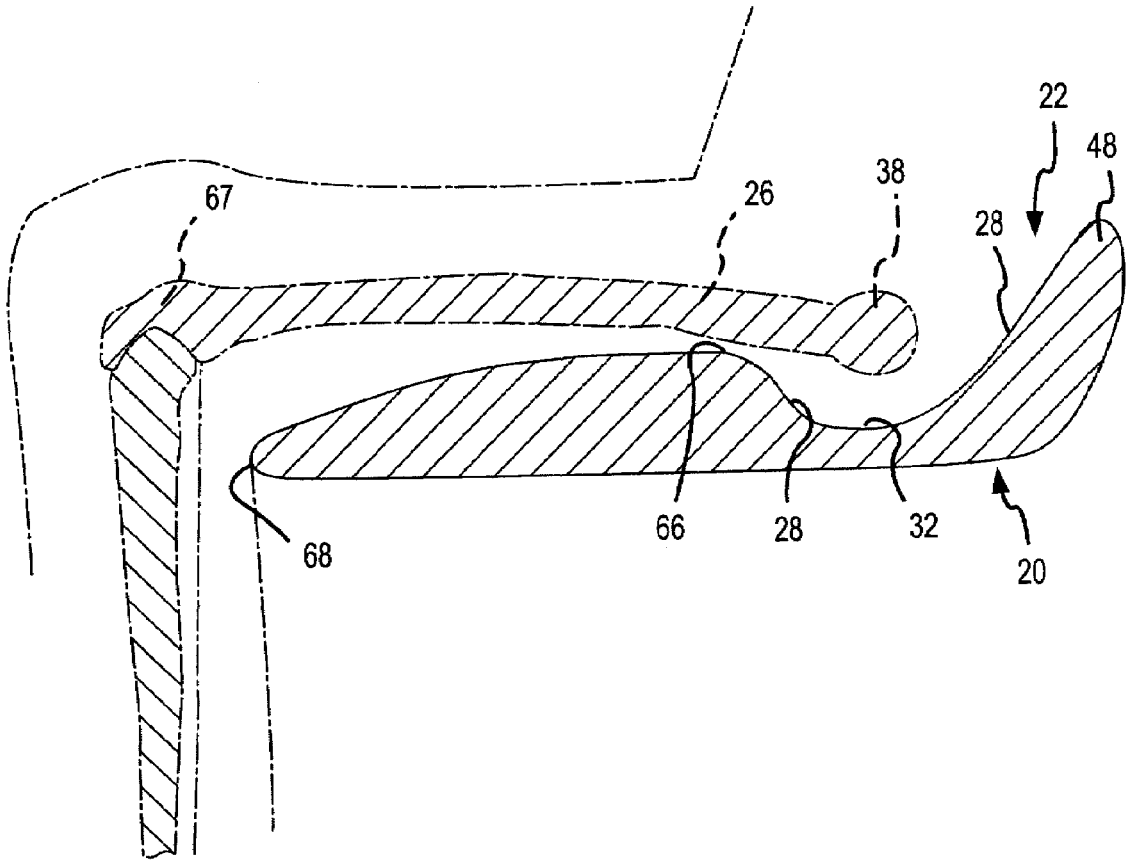
FIG. 6 is a longitudinal and vertical cross-sectional view taken substantially in the plane of line 6—6 of FIG. 2.

The support contour 22 rises from the lowermost surface area 32 on opposite transverse sides of the cavity 28 to a relief area 36, as shown in FIGS. 4, 6 and 8. The relief area 36 is positioned directly below and transversely to the outside of the greater trochanters 38 on both transverse sides of the support contour 22, when the user is seated on the cushion 20, as shown in FIG. 2. The greater trochanters 38 are the parts of the leg thigh bone 26 which extend to the "ball" part of the "hip joint," as those terms are referred to in common language. The "socket" part of the "hip joint" is located within the "hip" or pelvic bone 42.

The horizontal and transversely outwardly and upwardly curved portions of the relief area 36 are configured to establish a vertical and transverse clearance 44 with respect to the greater trochanters 38, as shown in FIG. 4. The relief area 36 is also configured to provide a longitudinal range of clearance 45 relative to the greater trochanters 38, as understood from FIG. 2. The curvature and position of the relief area 36 is sufficient to offload pressure and shear force from the skin surrounding the greater trochanters 38. It is primarily the skin below and to the transverse outside of the greater trochanters 38 that is susceptible to pressure and shear force when the user is seated on the cushion. The relief area 36 establishes enough relief through the clearances 44 and 45 to offload the pressure and shear force from the skin surrounding greater trochanters in these locations.

The clearances 44 and 45 are also sufficient to provide tolerance for slightly different seating positions of the user. This tolerance also accommodates movement of the greater trochanters 38 through a dynamic range of movement of the user.

Figure 7:
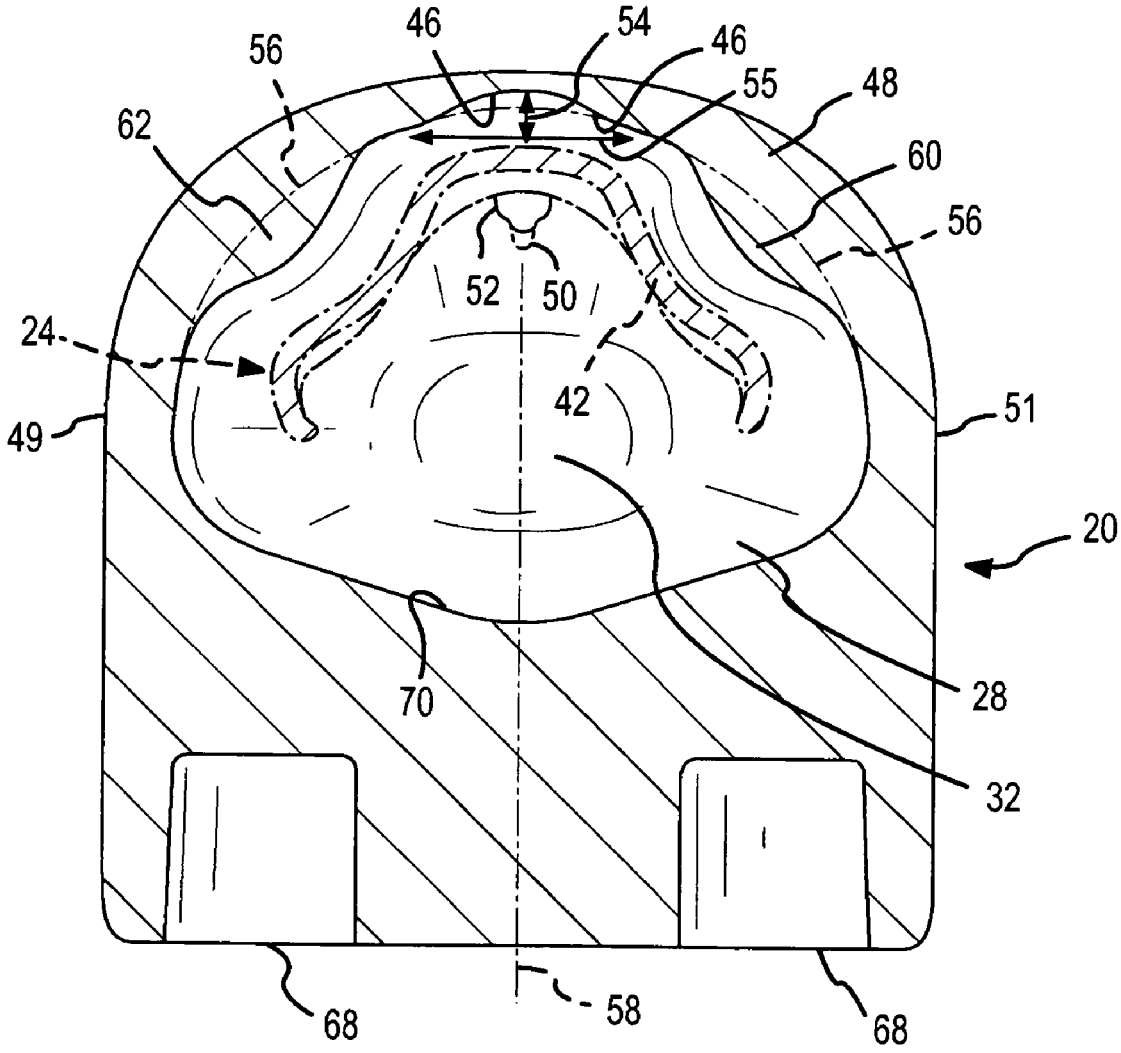
FIG. 7 is a transverse and substantially horizontal cross-sectional view taken substantially in the plane of line 7—7 of FIG. 3.

The support contour 22 also includes a recessed channel area 46 which extends vertically upward from the lowermost surface area 32 of the cavity 28 to an upper rear edge of the support contour 22, as shown in FIGS. 3, 7 and 8. The channel area 46 is located at approximately the transverse center of a rear wall 48. The rear wall 48 extends from one transverse side or edge 49 of the cushion 20 from a location generally adjacent to one greater trochanter relief area 36 around the rear of the cavity 28 to the other transverse side or edge 51 of the cushion 20 at a location generally adjacent to the other greater trochanter relief area 36, as shown in FIGS. 1, 2 and 8. The greater trochanter relief areas 36 generally curve vertically downward and transversely inward from the outer periphery of the back wall 48 at these opposite transverse positions of the support contour 22. As shown in FIG. 3, the rear wall 48 rises to an elevation at the rear of the cavity 28 which is sufficient to orient the pelvic area within the cavity 28 to resist rearward pivoting or rocking movement of the pelvic bones 42.

The channel area 46 is located on the rear wall 48 on opposite sides of a longitudinal midline 58 through the cushion 20. The channel area 46 extends downwardly and longitudinally forward from the back wall 48 toward the lowermost surface area 32 of the cavity 28 at the transverse midline of the support contour 22. The channel area 46 is positioned in the support contour 22 to be located directly behind the coccyx 50 and the sacrum 52 of the pelvic skeletal structure 24, when the user is seated in the cushion 20. The coccyx 50 is typically referred to in common language as the "tailbone."

The channel area 46 is recessed into the rear wall 48 of the cavity 28 to a sufficient distance to establish a vertical and horizontal clearance 54 between the channel area 46 and the coccyx 50 and sacrum 52, as shown in FIG. 3. The channel area 46 also establishes a transverse clearance 55 which extends beyond each opposite lateral side of the coccyx 50 and sacrum 52, as shown in FIG. 7. A general midline contour of the rear wall 48 is illustrated by the dashed line 56 in FIG. 7. The dashed line 56 represents the exact anatomical shape of the rear pelvic area of a specific or generalized user. The amount of recess of the channel 46 into the rear wall 48 is illustrated by the offset of the channel area 46 behind the dashed line 56. The transverse extent of the channel area 46 is illustrated by its extent on opposite sides of a longitudinal midline 58. Since the sacrum 52 generally tapers transversely inwardly toward the narrower coccyx 50, the channel area 46 may also have a slightly V-shaped curvature to generally parallel the downward and inward tapering of the sacrum 52 and coccyx 50.

The amount of the clearances 54 and 55 is sufficient to offload pressure and shear force from the skin surrounding the coccyx 50 and sacrum 52. Preferably, the clearances 54 and 55 are sufficient so that the skin surrounding the coccyx and sacrum does not even touch the channel area 46. The pressure and shear forces are offloaded under both static sitting conditions and under conditions of dynamic movement while in the seated position. By offloading the pressure and shear forces with the clearances 54 and 55, the risk of pressure ulcers on the skin surrounding the coccyx and sacrum is reduced substantially.

The lowermost surface area 32 of the cavity 28, the relief area 36, and the channel area 46 generally have the shape and position, relative to the anatomical shape of the user, to provide additional clearance in the support contour 22 in the location of those areas 32, 36 and 46 compared to the specific or a generalized anatomical shape. The additional clearance offloads pressure and shear forces from the skin surrounding the bony prominences of the ischial tuberosities 30, the greater trochanters 38, and the coccyx 50 and the sacrum 52. By offloading the pressure and shear forces from the skin surrounding these bony prominences, the risk of pressure ulcers is diminished.

To compensate for the increased clearance in the areas 32, 36 and 46, the support contour 22 provides greater protrusion for enhanced support in other areas 60, 62, 64 and 66 (FIG. 8) where there are relatively large and broad masses of tissue and muscle upon which the greater pressure can be applied without creating localized pressure points. The location of these greater or enhanced support areas is also established to encourage or orient the pelvic area 24 into a position which promotes postural alignment and control.

Figure 5:
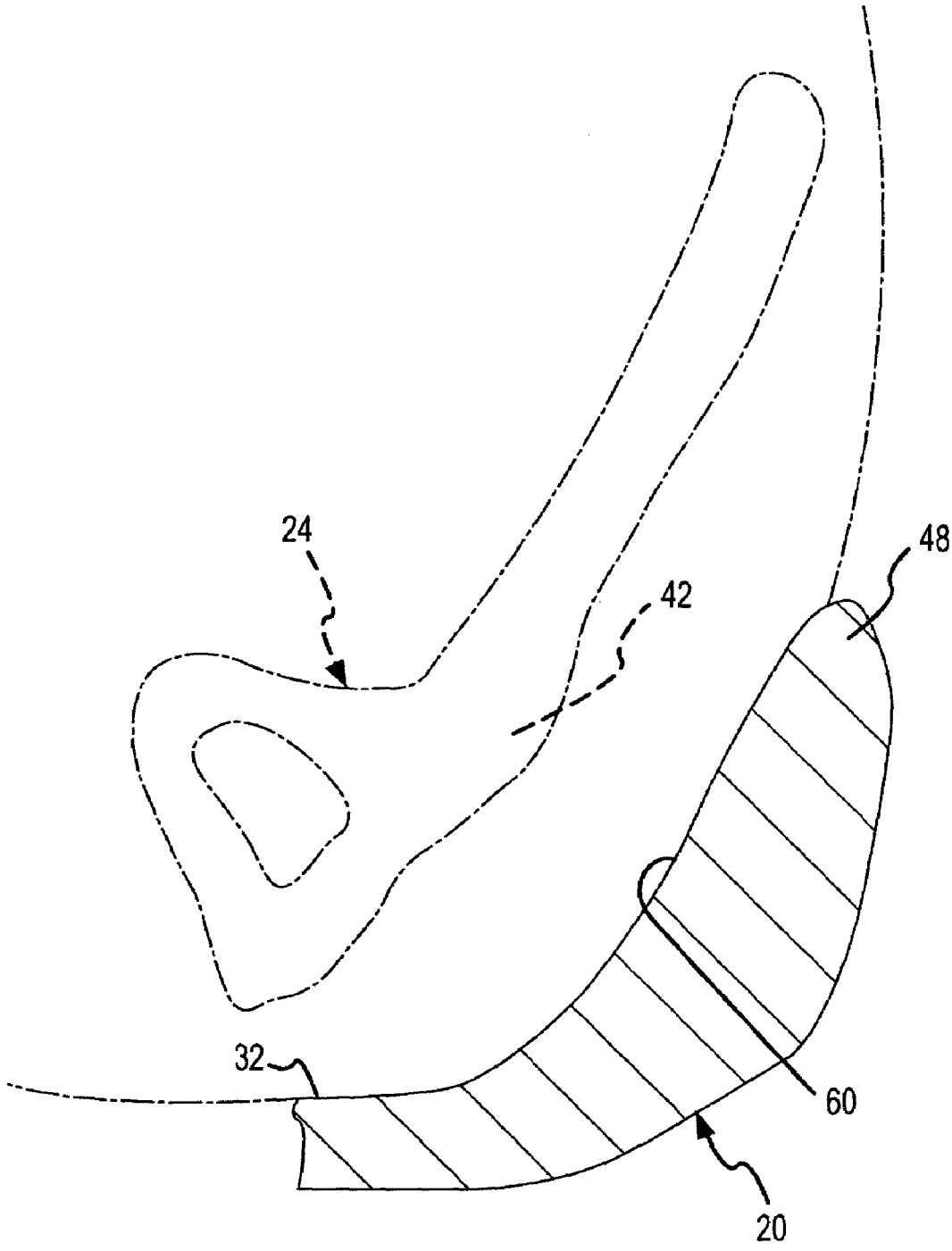
FIG. 5 is a vertical cross-sectional view of a portion of the support contour and skeletal structure shown in FIG. 2, taken substantially in the plane of line 5—5.

The support contour 22 includes two support areas 60 and 62 which are located on the back wall 48 of positions on opposite transverse sides of the longitudinal midline 58, as shown in FIGS. 5 and 7. The support areas 60 and 62 extend forwardly from the midline contour line 56, and therefore provide more protuberance to create exaggerated pressure and support on the tissue and musculature at the posterior lateral buttocks of the pelvic area which is contacted by the support areas 60 and 62. As shown in FIG. 5, the support area 60 (the support area 62 is similar, but not shown in FIG. 5) generally curves vertically downwardly and transversely and longitudinally forwardly from an upper position on the back wall 48 toward the lowermost surface area 32. The support areas 60 (and 62, not shown in FIG. 5) terminate vertically above the lowermost surface area 32. Oriented in this manner, the support areas 60 and 62 define forwardly and upwardly facing contact surfaces to contact the skin covering the tissue masses surrounding the pelvic bones 42 at the lateral posterior buttocks. The posterior lateral buttocks tissue and musculature are devoid of any underlying prominent bone structure. Instead, the considerable mass of posterior lateral buttocks tissue and musculature defines a relatively broad and substantial contact area which is able to accept and transfer the force into the pelvic skeletal structure which does not elevate the risk of developing pressure ulcers at those locations.

The enhanced support transferred into the lateral buttocks tissue and musculature from the support areas 60 and 62 biases or orients the pelvic area 42 in a slightly forward pivoted position (counterclockwise as shown in FIG. 3) which is the typical position for proper postural alignment. Without some encouragement to pivot the pelvic area 42 toward a position of proper postural alignment, some wheelchair users may tend to slouch or sink downwardly, thereby rotating the pelvic area 42 into an improper alignment (clockwise as shown in FIG. 3). The upward and forward support from the lateral buttocks support areas 60 and 62 encourages the user to maintain his or her pelvic area 24 in a proper postural alignment position.

The upward component of curvature from the support areas 60 and 62 (FIG. 5) tends to induce an upward lifting force on the pelvic area, which assists in offloading the pressure from the relief areas 32, 36 and 46. The lateral buttocks support areas 60 and 62 also provide lateral stability which helps retain the user in contact with the support contour 22 of the seat cushion 20. The lateral support stability is applied from the opposite sides of the rear portion of the users body, and thus tends to inhibit the user from tipping backward or to the side within the cushion.

The support contour 22 also provides enhanced support from areas 64 and 66 which are located beneath the thigh bone 26 proximal to the greater trochanters 38, as shown in FIGS. 3, 6 and 8. The enhanced support areas 64 and 66 contact a relatively broad mass of tissue and muscle extending along the proximal thigh bone 26. The proximal thigh bone 26 extends generally longitudinally and has no prominences in the area where the support areas 64 and 66 contact the tissue surrounding the proximal thigh bones 26. The support areas 64 and 66 are able to transfer a relatively significant amount of pressure into the relatively broad mass of proximal thigh tissue and musculature to thereby support the skeletal structure.

As shown in FIGS. 3 and 6, the forward portion of the cavity 28 curves upward from the lowermost surface area 32 to the upper surface of the support areas 64 and 66. The extent of the upward curvature and the position of the support areas 64 and 66 is somewhat elevated above that position which would normally be defined by a general or specific anatomical structure. In general, the proximal thigh support areas 64 and 66 generally have the highest elevation at any location beneath the thigh bone 26. By elevating the support areas 64 and 66 slightly, a greater amount of support and pressure is applied on the proximal thigh bones.

Each of the support areas 64 and 66 is laterally displaced from the longitudinal midline 58, in order to be located beneath the thigh bones 26. In general, the support areas 64 and 66 generally extend transversely in a somewhat generally-horizontal shelf-like manner. In general, as shown from FIG. 3, the vertical heights of the support areas 64 and 66 are somewhat lower than the upper edges of the lateral buttocks support areas 60 and 62, because the tissue and musculature located beneath the proximal thigh bone 26 is located at a lower support position on the seated human anatomy than the lateral buttocks tissue and musculature.

The support areas 64 and 66 are located to interact with the thigh bones 26 at a position which is considerably closer to the location where the thigh bones 26 terminate at one end at the hip joints (not shown, but which are adjacent to the greater trochanters 38) compared to the locations at the opposite end of the thigh bones 26 where the thigh bones 26 terminate at knee joints 67, as understood from FIG. 6. Located in this manner, the support areas 64 and 66 act as a fulcrum for the thigh bones 26 for transferring the weight of the lower legs into the pelvic area 24. By locating the fulcrum-like protrusion of the support areas 64 and 66 relatively close to the pelvic area, the weight of the lower legs is transferred with a mechanical advantage into the pelvic area. The resulting weight transfer has the effect of naturally and inherently lifting the pelvic area. The lifting force on the pelvic area assists in separating the bony prominences from the relief areas of the support contour 22 and maintaining the clearances in those areas while simultaneously decreasing the pressure in those areas. The lifting force on the pelvic area 24 also tends to complement the upward force created by reaction with the enhanced support areas 60 and 62. The enhanced support areas 60 and 62 also interact with the upward lifting force at the hips to prevent the pelvis from tipping backward in response to the lifting force. The lifting force transferred from the distal legs through the hip joints cooperates with the upward support force from the support areas 60 and 62 to encourage proper posture through upward alignment of the pelvic area at four stabilizing and counterbalancing locations at the hip joints and posterior lateral buttocks. The fulcrum-like mechanical advantage from the support areas 64 and 66 offers considerable benefit to wheelchair users who have diminished muscle capacity or control in the pelvic region.

The transfer of significant force into the proximal thigh tissue and musculature at the location of the support areas 64 and 66 complements the additional support from the areas 60 and 62 to maintain alignment for proper postural position of the pelvic area. The location of the support areas 60, 62, 64 and 66, as shown in FIG. 8, is at approximately the four transverse and longitudinal positions surrounding the pelvic structure to facilitate holding the pelvic structure into a position of proper postural alignment and to stabilize the user when seated on the support contour.

The support contour 22 slopes generally downward from each of the proximal thigh support areas 64 and 66, until it encounters a rounded front edge 68 of the cushion 20. The downward slope from the areas 64 and 66 to the front edge 68 of the cushion facilitates focusing the broad area of support on the tissue and musculature of the proximal thigh at the support areas 64 and 66, rather than to some other position closer to the knee joint 67 which might not provide the best support and weight transfer for proper postural position.

The portion of the support contour 22 which extends forward from the proximal thigh support areas 64 and 66 is somewhat downwardly oriented. This downward orientation helps maintain the thigh bones 26 in the forward extending manner within the seat cushion 20, to thereby assure that the tissue and musculature of the proximal thigh bone is located in contact with the support areas 64 and 66.

The support contour 22 also includes a clearance or relief area 70 which provides additional clearance in the perineal or genital area for the user sitting on the support contour 22. The additional clearance area 70 creates a space for relief of pressure and enhancement of air circulation where the skin is prone to breakdown from heat and moisture. Relieving the pressure and providing a space for air circulation in the area 70 is a substantial benefit to wheelchair and other users who must remain seated for long periods of time, by reducing the incidence of skin breakdown and sores in the perineal area.

The clearance area 70 generally curves upwardly and forwardly from the lowermost surface area 32 of the cavity 28 along the longitudinal midline, shown in FIG. 3. The upward and forward curvature at the longitudinal centerline is more gentle and extends farther forward than the more abrupt vertical and forward curvature of the cavity beneath the thigh bones 26, as understood by comparing FIGS. 3 and 6. Consequently, in a transverse sense, the area 70 extends slightly forwardly from the rear of the thigh support areas 64 and 66, as shown in FIGS. 1, 2, 7 and 8.

As is shown in FIG. 8, the areas 32, 36 and 46 are located to offload pressure and shear force from the skin surrounding the bony prominences of the pelvic area, i.e. the ischial tuberosities 28, the greater trochanters 38, and the coccyx 50 and sacrum 52. The pressure and shear force is offloaded by providing greater relief in the support contour 22 in the areas 32, 36 and 46. The greater relief is obtained by exaggerating the clearance of the support contour 22 in the areas 32, 36 and 46 compared to a contour which would generally complement the anatomical shape in those areas. The areas 60, 62, 64 and 66 provide enhanced support or exaggerated protrusion, to compensate for the clearance in the areas 32, 36 and 46, and to orient or bias the pelvic area into a position of proper postural alignment. The location of the enhanced support areas 60, 62, 64 and 66 is to contact relatively broad masses of tissue and musculature which are devoid of bony prominences. The relatively broad mass of tissue and musculature is able to withstand the increased pressure from the support areas 60, 62, 64 and 66 without substantially increasing the risk of pressure ulcers. The support transferred from the four support areas 60, 62, 64 and 66 is generally applied to the pelvic area skeletal structure 24 at four points at the front and back and opposite transverse positions, thereby providing the best lateral and longitudinal support for stability purposes.

By providing greater clearance in the area of the bony prominences and more support in the areas of broad tissue and muscle mass, the support contour 22 departs from an exact negative or complement of the shape of the user. However, to create the areas 32, 36 and 46 of enhanced clearance, and the areas 60, 62, 64 and 66 of enhanced support, it is necessary to obtain the shape of the specific user or a general class of users and then modify that shape to obtain the characteristics of the areas 32, 36, 46, 60, 62, 64 and 66. The above-referenced U.S. patent application Ser. No. 10/628,858 describes an advantageous technique for obtaining the anatomical shape of a wheelchair user and forming the cushion 20.

The type of moldable material preferred for use in the present invention is generally circular polyethylene beads. Each of the polyethylene beads is formed with an exterior coating which is activated by heat. Once activated, the coating of each bead adheres to the coating of its adjoining beads, thereby linking all of the beads together in a single matrix-like structure which forms the resilient support structure from which the cushion is formed.

The plastic beads are available in different shapes, sizes, densities and materials. For polyethylene spherical beads, the typical diameter is in the range of 0.1875 to 0.25 inches, and the typical density is in the range of 12 grams per liter to 27 grams per liter. When sguare or pillow-shaped polypropylene beads are used, the size may be in the range of approximately 0.1875 inches on the side to approximately 0.09375 inches on the side, with a density of approximately 29 grams per liter.

Because of the generally circular nature of the beads and the fact that the beads are fused together at contact points, the resulting matrix-like structure of adhered beads has porosity which allows air and liguid to pass through the matrix-like support structure. This is a particular advantage in wheelchair cushions, because the ventilation of air to the areas of skin which are at risk for pressure ulcers generally decreases the incidence of such pressure ulcers.

By offloading pressure from the bony prominence areas 32, 36 and 46, and by applying the exaggerated support in the broad tissue and musculature areas 60, 62, 64 and 66, atrophy changes are less likely to have a significant negative impact. In general, the added clearance in the areas of the bony prominences provides an additional tolerance for tissue atrophy.

The increased clearance from the areas 32, 36 and 46, and the increased prominence of the support areas 60, 62, 64 and 66 also makes the support contour 22 more generally applicable to classes of individual users. By adjusting the extent of clearances and prominences of the areas 32, 36, 46, 60, 62, 64 and 66 to accommodate a few classes of individual users. For example, one standard variation of the support contour 22 may primarily accommodate the wider spread and shallower slope of the ischial tuberosities of the female skeletal bone structure. Another standard variation of the support contour 22 may accommodate the narrower and steeper slope of the ischial tuberosities of the male skeletal bone structure. Another standard variation of the support contour 22 is not gender-specific, but has a deeper and steeper profile. This deeper and steeper support contour 22 may provide better protection for individuals with soft tissue atrophy. However regardless of sex or degree of tissue atrophy, any user may prefer any one of these different standard variations of support contours, depending on personal comfort, support and preference. The benefits of the support contour 22 thereby extend to a substantial population of wheelchair users without requiring that population to obtain a custom wheelchair cushion. This benefit is more specifically described in the above-referenced U.S. patent application Ser. No. 10/628,859.

Many of the same considerations applicable to wheelchair users and wheelchair seat cushions are also applicable with varying levels of criticality to other types of seat cushions used in other seating applications and environments. For example, seat cushions used in office chairs are required to support the user for relatively long periods of time in a comfortable manner which encourages proper postural alignment and without creating risks of medical problems, for example inducing blood circulatory problems. The support contour 22 will adapt to accommodate the support and postural needs of individuals in many different seating applications and environments. Many other advantages and improvements will be apparent after gaining a full appreciation of the present invention.

A presently preferred embodiment of the present invention and many of its improvements have been described with a degree of particularity. This description is a preferred example of implementing the invention, and is not necessarily intended to limit the scope of the invention. The scope of the invention is defined by the following claims.

What is claimed is:

1. A cushion having an upward facing support contour adapted to interact with a pelvic area anatomy of a person and support the person in a seated position while offloading support pressure from skin covering the ischial tuberosities and the greater trochanters and the coccyx and sacrum while transfering the support pressure to tissue masses on opposite lateral sides of the posterior buttocks and beneath the proximal thigh bones, when the person is seated on and supported by the support contour, wherein:

the support contour includes support areas and relief areas are separate from one another, the support areas are at locations adapted to be adjacent to skin at the tissue masses on the opposite lateral sides of the posterior buttocks and beneath the proximal thigh bones, the relief areas are at locations adapted to be adjacent to skin covering the ischial tuberosities, the greater trochanters and the coccyx and sacrum, and the support areas and the relief areas are spaced relatively more toward and relatively more away from the anatomical shape of the pelvic area of the person when the person is seated on and supported by the support contour, the cushion and the support contour are formed by an integral piece of resilient support material having the necessary resilience to establish and maintain the support areas and the relief areas in the manner herein recited when the person is seated on and supported by the support contour;

the cushion extends longitudinally from a rear wall to a front edge and extends transversely between opposite transverse edges, each transverse edge extends longitudinally between the rear wall and the front edge, and the rear wall has a general midline contour which represents the anatomical shape of a rear portion of the pelvic area of the person;

the support contour is defined relative to a longitudinal midline which extends midway between the opposite transverse edges, and is further defined relative to the horizontal and the vertical, the horizontal having a component which extends longitudinally and transversely and the vertical having a component which extends perpendicular to the horizontal;

the support contour includes a cavity forward of the rear wall and extending downward to a lower surface which is adapted to be located beneath the ischial tuberosities when the person is seated on and supported by the support contour;

the lower surface of the cavity constituting an ischial tuberosities relief area which is spaced from the ischial tuberosities to substantially offload pressure and shear force from the skin adjacent to the isohial tuberosities when the person is seated on and supported by the support contour;

the support contour includes two transverse relief areas spaced transversely to the outside of the cavity and which are adapted to be located beneath the greater trochanters when the person is seated on and supported by the support contour, each transverse relief area is spaced vertically above the lower surface of the cavity;

the transverse relief areas each constituting a greater trochanter relief area which is spaced from each greater trochanter to substantially offload pressure and shear force from the skin adjacent to the each greater trochanter when the person is seated on and supported by the support contour;

the support contour includes a channel in the rear wall at a location approximately centered transversely about the longitudinal midline and recessed rearward into the rear wall relative to the midline contour of the rear wall, the channel is adapted to be located behind and transversely to the sides of the coccyx and the sacrum when the person is seated on and supported by the support contour;

the channel constituting a coccyx and sacrum relief area which is spaced sufficiently from the coccyx and sacrum to substantially offload pressure and shear force from the skin adjacent to the coccyx and sacrum when the person is seated on and supported by the support contour;

the support contour including two rear support areas located on the rear wall on respectively opposite transverse sides of the longitudinal midline and between the channel and the greater trochanters relief areas, each rear support area protruding forward relative to the midline contour of the rear wall, each rear support area is adapted to be located adjacent to the skin and tissue masses on opposite lateral sides of the posterior buttocks when the person is seated on and supported by the support contour;

the rear support areas each constituting lateral posterior buttocks support areas which induce upward support pressure on the opposite lateral sides of the posterior buttocks when the person is seated on and supported by the support contour;

two forward support areas located forward of the cavity and spaced transversely on opposite sides of the longitudinal midline, each forward support area located vertically higher than the greater trochanters relief areas, the forward support areas are adapted to be located beneath the proximal thigh bones at a position which is closer to the greater trochanters compared to the location of knee joints on the thigh bones when the person is seated on and supported by the support contour;

the forward support areas constituting proximal thigh support areas which induce upward support pressure while interacting in a fulcrum-like manner with the proximal thigh bones to create elevational force at the hip joints from weight of the distal legs to elevate the greater trochanters relative to the greater trochanter relief areas when the person is seated on and supported by the support contour; and the upward support pressure induced from the lateral posterior buttocks support areas and from the proximal thigh support areas transferring substantially the entire support pressure to tissue masses on opposite lateral sides of the posterior buttocks and beneath the proximal thigh bones while substantially offloading support pressure from skin covering the ischial tuberosities and the greater trochanters and the coccyx and sacrum when the person is seated on and supported by the support contour.

2. A cushion as defined in claim 1, wherein:

the locations of the proximal thigh support areas establish a lever-like mechanical advantage for increasing the amount of elevational force at the hip joints from the weight of the distal legs.

3. A cushion as defined in claim 1, wherein:

the channel has a V-shaped curvature of increasing transverse width with increasing vertical height above the lower surface of the cavity.

4. A cushion as defined in claim 1, wherein:

the support pressure from the lateral posterior buttocks support areas prevents the pelvic area from tipping backward in response to the elevational force at the hip joints.

5. A cushion as defined in claim 1, wherein:

the upward support pressure induced from the rear support areas and from the proximal thigh support areas also facilitate postural alignment and stabilization of the pelvic area against forward and backward and lateral side to side movement when The person is seated on and supported by the support contour.

6. A cushion as defined in claim 1, wherein:

the ischial tuberosities relief area and the greater trochanters relief areas and the coccyx and sacrum relief area are of sufficient size to offload pressure from the skin covering the ischial tuberosities and the greater trochanters and the coccyx and sacrum during normal forward and backward pivoting movement of the pelvic area and an upper torso of the person when seated on and supported by the support contour.

7. A cushion as defined in claim 1, wherein:

the support contour includes a clearance area extending upward and forward from the lower surface of the cavity and approximately centered about the longitudinal midline, the clearance area adapted to be located adjacent to a perineal area of the person when seated on and supported by the support contour, the clearance area establishing space for air circulation at the perineal area.

8. A cushion as defined in claim 7, wherein:

the integral piece of support material comprises a matrix of resilient adhered-together plastic beads having spaces between the beads to establish permeability for air movement within the integral piece of support material.

9. A cushion as defined in claim 8 for use on a wheelchair.

10. A method of configuring a support contour of a cushion to adapt the support contour to interact with a pelvic area anatomy of a person and support the person in a seated position to offload support pressure from skin covering the ischial tuberosities and the greater trochanters and the coccyx and sacrum while transfering substantially the entire support pressure to tissue masses on opposite lateral sides of the posterior buttocks and beneath the proximal thigh bones, when the person is seated on and supported by the support contour, comprising:

defining support areas and relief areas of the support contour which are separate from one another;

locating the support areas at locations on the support contour which are adapted to be adjacent to skin at the tissue masses on the opposite lateral sides of the posterior buttocks and beneath the proximal thigh bones when the person is seated on and supported by the support contour;

locating relief areas at locations on the support contour which are adapted to be adjacent to skin covering the ischial tuberosities, the greater trochanters and the coccyx and sacrum;

spacing the support areas relatively closer to the tissue masses on the opposite lateral sides of the posterior buttocks and beneath the proximal thigh bones and spacing the relief areas relatively further away from the skin covering the ischial tuberosities and the greater trochanters and the coccyx and sacnam;

forming the support areas and the relief areas on an integral piece of resilient support material having the necessary resilience to establish and maintain the support areas and the relief areas in the manner herein recited when the person is seated on and supported by the support contour;

orienting the support areas on the opposite lateral sides of the posterior buttocks to induce an upward component of support pressure on the tissue masses on the opposite lateral sides of the posterior buttocks when the person is seated on and supported by the support contour;

locating the support areas beneath the proximal thigh bones closer to hip joints than to knee joints of the thigh bones when the person is seated on and supported by the support contour; and elevating the support areas beneath the proximal thigh bones relative to the relief areas below the greater trochanters to establish fulcrums from which an upward component of elevational force is induced by the thigh bones at the hip joints from weight of the distal legs interacting in a lever-like manner with the support areas beneath the proximal thigh bones while the support pressure is applied from the support areas beneath the proximal thigh bones when the person is seated on and supported by the support contour and wherein:

the support areas at the posterior lateral buttocks and the support areas beneath the proximal thigh bones transfer substantially the entire support pressure to tissue masses on opposite lateral sides of the posterior buttocks and beneath the proximal thigh bones while the relief areas substantially offload support pressure from skin covering the ischial tuberosities and the greater trochanters and the coccyx and sacrum when the person is seated on and supported by the support contour.

11. A method as defined in claim 10, wherein:

shaping the coccyx and sacrum relief area in an upright V-shape having increasing transverse width with increasing vertical height.

12. A method as defined in claim 10, wherein:

the relief areas are of sufficient size to offload support pressure from the skin covering the ischial tuberosities and the coccyx and sacrum during forward and backward pivoting movement of the pelvic area and an upper torso of the person when seated on and supported by the support contour.

13. A method as defined in claim 10, wherein:

orienting the support areas beneath the posterior lateral buttocks to induce support pressure to prevent the pelvic area from tipping backward in response to the elevational force at the hip joints when the person is seated on and supported by the support contour.

14. A method as defined in claim 10, wherein:

defining a clearance area adapted to be located adjacent to a perineal area of the person when seated on and supported by the support contour, the clearance area establishing space for air circulation at the perineal area when the person is seated on a supported by the support contour.

15. A method as defined in claim 10, wherein:

the integral piece of support material is a matrix of resilient adhered-together plastic beads having spaces between the beads to establish permeability for air movement within the integral piece of support material.

16. A method as defined in claim 15, wherein the cushion is for use on a wheelchair.

17. A method of supporting a person on a support contour of a cushion in a seated position, the support contour adapted to interact with a pelvic area anatomy of the person and support the person in the seated position while offloading support pressure from skin covering the ischial tuberosities and the greater trochanters and the coccyx and sacrum of the pelvic area of the person and while transfering substantially support pressure to tissue masses on opposite lateral sides of the posterior buttocks and beneath the proximal thigh bones when the person is seated on and supported by the support contour, comprising:

contacting support areas of the support contour with skin at the tissue masses on the opposite lateral sides of the posterior buttocks and beneath the proximal thigh bones;

transferring support pressure to support the person from the support contour in the seated position from the support areas to the skin and tissue masses contacted by the support areas;

locating relief areas of the support contour adjacent to skin covering the ischial tuberosities, the greater trochanters and the coccyx and sacrum;

spacing the relief areas to substantially offload support pressure and shear force from the skin covering the ischial tuberosities, the greater trochanters and the coccyx and sacrum;

using an integral piece of resilient support material having the necessary resilience to establish and maintain the support areas in the relief areas in the manner herein recited;

inducing an upward component of support pressure on the tissue masses on the opposite lateral sides of the posterior buttocks from the support areas on the opposite lateral sides of the posterior buttocks;

inducing an upward elevational force on the pelvic area from the thigh bones at the hip joints caused by weight of the distal legs interacting in a lever-like manner with the support areas beneath the proximal thigh bones while simultaneously applying support pressure from the support areas beneath the proximal thigh bones;

transferring substantially the entire support pressure from the support areas to the tissue masses on opposite lateral sides of the posterior buttocks and beneath the proximal thigh bones; and offloading any substantial support pressure from skin covering the ischial tuberosities and the greater trochanters and the coccyx and sacrum.

18. A method as defined in claim 17, further comprising:

substantially eliminating any support pressure on the skin surrounding the ischial tuberosities and the coccyx and the sacrum during an anticipated range of normal forward and backward and side to side movement of the pelvic area and an upper torso of the person.

19. A method as defined in claim 17, further comprising:

inducing upward support pressure from the support areas at the lateral posterior buttocks to prevent the pelvic area from tipping backward in response to the elevational force at the hip joints.

20. A method as defined in claim 17, further comprising:

inducing the upward support pressure from the support areas to facilitate postural alignment and stabilization of the pelvic area against forward and backward and lateral side to side movement.

21. A method as defined in claim 17, further comprising:

providing a clearance area of the support contour which is adapted to be located adjacent to a perineal area of the person when seated on and supported by the support contour; and establishing space at the clearance area for air circulation to the perineal area.

22. A method as defined in claim 17, further comprising:

using as the support material a matrix of resilient adhered-together plastic beads having spaces between the beads to establish permeability for air movement in the support material.

23. A method as defined in claim 22, further comprising:

using the cushion on a wheelchair.

* * * * *